US008056608B2

(12) United States Patent
Goodwin et al.

(10) Patent No.: US 8,056,608 B2
(45) Date of Patent: Nov. 15, 2011

(54) METHOD OF MITIGATING AGAINST THERMAL CONTRACTION INDUCED CRACKING DURING CASTING OF A SUPER NI ALLOY

(75) Inventors: Richard Stanley Goodwin, Croxton (GB); Stephen Roberts, Stoke-on-Trent (GB)

(73) Assignee: Goodwin PLC, Stoke-on-Trent (GB)

( * ) Notice: Subject to any disclaimer, the term of this patent is extended or adjusted under 35 U.S.C. 154(b) by 0 days.

(21) Appl. No.: 12/989,010

(22) PCT Filed: Apr. 24, 2009

(86) PCT No.: PCT/GB2009/001048

§ 371 (c)(1),
(2), (4) Date: Oct. 21, 2010

(87) PCT Pub. No.: WO2009/130472

PCT Pub. Date: Oct. 29, 2009

(65) Prior Publication Data

US 2011/0036535 A1 Feb. 17, 2011

(30) Foreign Application Priority Data

Apr. 25, 2008 (GB) ..... 0807614.3

(51) Int. Cl.
*B22D 27/04* (2006.01)
*B22C 9/08* (2006.01)

(52) U.S. Cl. ..... 164/122.1; 164/122; 164/493; 164/359

(58) Field of Classification Search ..... 164/122–122.2, 164/338.1, 359, 493, 513; 249/82, 105–110, 249/197–202
See application file for complete search history.

(56) References Cited

U.S. PATENT DOCUMENTS

| | | | | |
|---|---|---|---|---|
| 1,789,883 | A * | 1/1931 | Roth | 249/197 |
| 3,680,624 | A | 8/1972 | Watts | |
| 3,752,221 | A | 8/1973 | Copley et al. | |
| 4,178,986 | A | 12/1979 | Smashey | |
| 4,460,524 | A | 7/1984 | Takahashi et al. | |
| 4,475,721 | A | 10/1984 | Pamart | |
| 4,812,470 | A | 3/1989 | Rogers et al. | |
| 4,972,899 | A | 11/1990 | Tungatt | |
| 5,201,359 | A | 4/1993 | McMullen | |
| 5,708,257 | A | 1/1998 | Comarteau et al. | |
| 5,765,730 | A | 6/1998 | Richter | |
| 5,853,605 | A | 12/1998 | Comarteau et al. | |
| 5,884,687 | A | 3/1999 | Schwarzkopf | |
| 6,676,381 | B2 | 1/2004 | Subramanian et al. | |
| 2003/0190235 | A1 | 10/2003 | Subramanian et al. | |
| 2005/0035504 | A1 | 2/2005 | Kitaoka et al. | |
| 2007/0084581 | A1 | 4/2007 | Graham et al. | |

FOREIGN PATENT DOCUMENTS

DE 3506599 A1 1/1986

(Continued)

*Primary Examiner* — Jessica L Ward
*Assistant Examiner* — Kevin E Yoon
(74) *Attorney, Agent, or Firm* — Harness, Dickey & Pierce, P.L.C.

(57) ABSTRACT

A method of mitigating against thermal contraction induced cracking during casting of a super Ni alloy, the method comprising: pouring liquid alloy into a mould such that liquid alloy is present in a feeder of said mould; and inducing an electrical current in alloy in said feeder to reduce a rate of cooling of alloy in said feeder.

20 Claims, 2 Drawing Sheets

FOREIGN PATENT DOCUMENTS

Figure 1:
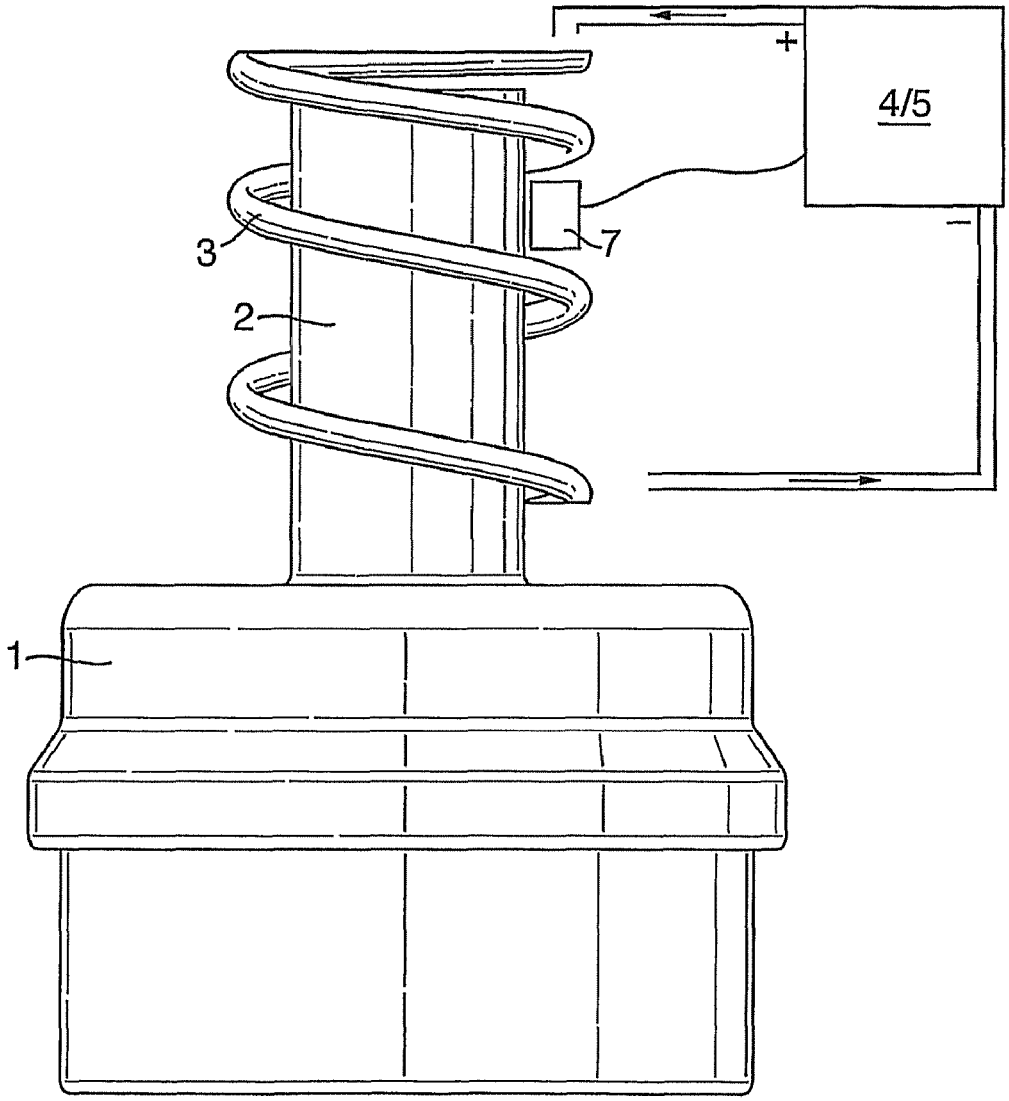

| | | | |
|---|---|---|---|
| EP | 0100272 | A1 | 2/1984 |
| EP | 0103220 | A1 | 3/1984 |
| EP | 0119853 | A2 | 9/1984 |
| EP | 0387107 | A2 | 9/1990 |
| EP | 0682575 | A1 | 11/1995 |
| EP | 0800427 | A1 | 10/1997 |
| EP | 1704007 | A1 | 9/2006 |
| FR | 2566301 | A1 | 12/1985 |
| FR | 2670697 | A1 | 6/1992 |
| FR | 2674154 | A1 | 9/1992 |
| FR | 2701225 | A1 | 8/1994 |
| FR | 2727883 | A1 | 6/1996 |
| GB | 578123 | A | 6/1946 |
| GB | 890467 | A | 2/1962 |
| GB | 947626 | A | 1/1964 |
| GB | 1083262 | A | 9/1967 |
| GB | 1094651 | A | 12/1967 |
| GB | 1481301 | A | 7/1977 |
| GB | 1541587 | A | 3/1979 |
| GB | 2160456 | A | 12/1985 |
| GB | 2198977 | A | 6/1988 |
| GB | 2311240 | B | 11/1999 |
| JP | 55064958 | A | 5/1980 |
| JP | 55100846 | A | 8/1980 |
| JP | 55120451 | A | 9/1980 |
| JP | 58125345 | A | 7/1983 |
| JP | 61286054 | A | 12/1986 |
| JP | 63093460 | A | 4/1988 |
| JP | 63126646 | A | 5/1988 |
| JP | 63242447 | A | 10/1988 |
| JP | 1015273 | A | 1/1989 |
| JP | 3035865 | A | 2/1991 |
| JP | 3042170 | A | 2/1991 |
| JP | 4088134 | A | 3/1992 |
| JP | 6320235 | A | 11/1994 |
| JP | 7303953 | A | 11/1995 |
| JP | 7328746 | A | 12/1995 |
| JP | 8071733 | A | 3/1996 |
| JP | 8290238 | A | 11/1996 |
| JP | 8332557 | A | 12/1996 |
| JP | 09314310 | A | 12/1997 |
| JP | 10277702 | A | 10/1998 |
| JP | 11033678 | A | 2/1999 |
| JP | 11033703 | A | 2/1999 |
| JP | 2000190051 | A | 7/2000 |
| JP | 2001-225154 | A | 8/2001 |
| JP | 2003305549 | A | 10/2003 |
| JP | 2005000926 | A | 1/2005 |
| JP | 2005329450 | A | 12/2005 |
| JP | 2006205191 | A | 8/2006 |
| KR | 20030087109 | A | 11/2003 |
| SU | 1444058 | A1 | 12/1988 |
| WO | WO-9617703 | A1 | 6/1996 |
| WO | WO-2005051570 | A1 | 6/2005 |
| WO | WO-2006011822 | A1 | 2/2006 |

* cited by examiner

METHOD OF MITIGATING AGAINST THERMAL CONTRACTION INDUCED CRACKING DURING CASTING OF A SUPER NI ALLOY

CROSS-REFERENCE TO RELATED APPLICATIONS

This application is a 371 U.S. National Stage of International Application No. PCT/GB2009/001048, filed Apr. 24, 2009. This application claims the benefit of United Kingdom Patent Application No. 0807614.3, filed Apr. 25, 2008. The disclosures of the above applications are incorporated herein by reference.

The present application relates to a method of casting a super Ni alloy, particularly to large castings in which cracking can be a problem.

An apparatus for making a casting comprises a mould defining the shape of the desired product and a feeder. A casting is where molten metal is poured into a mould which has a shape the same as or close to a desired final shape. This is different to an ingot which generally has a less complicated shape and will be subjected to further thermomechanical processing before acquiring its final shape. Molten metal is usually poured through an ingate or the feeder into the mould. The spherical volume of the feeder is chosen so that the feeder head (i.e. the metal in the feeder) solidifies after the metal in the remainder of the mould. Usually this requires the equivalent spherical volume of the feeder to be larger than the equivalent spherical volume of the casting. More than one feeder can be used per casting.

A riser or feeder or feeder pipe is a reservoir built into a metal-casting (sand) mould to prevent cavities due to shrinkage. Because metals are less dense as liquids than as solids, castings shrink as they cool. This can leave a void, generally at the last point to solidify. Risers prevent this by providing molten metal at the point of likely shrinkage, so that the cavity forms in the metal solidifying in the feeder, not in the casting itself.

Until now it has not been possible to produce large super Ni alloy castings. This is because when such large super Ni alloy castings have been made using traditional models to calculate an effective feeder size, cracks have appeared in the castings.

The present invention provides a method of mitigating against thermal contraction induced cracking during casting of a super Ni alloy, the method comprising: pouring liquid alloy into a mould such that liquid alloy is present in a feeder of said mould; and inducing an electrical current in alloy in said feeder to reduce a rate of cooling of alloy in said feeder.

In this way a large super Ni alloy casting may be made without cracking. This is achieved either by using a diameter of feeder which is smaller than the calculated effective feeder diameter and by heating alloy in the feeder to ensure that it does not chill off (described below) or by reducing the magnitude of temperature differences within alloy in the feeder so that large thermal stresses, particularly at the interface between the riser and the casting, are not generated. In this case the diameter of the feeder head may be greater or less than the effective feeder diameter and may be greater than the diameter at which cracking occurs (to ensure enough live liquid volume is available). Thereby the difficulty which exists in casting super Ni alloys (which does not exist with steels or other traditionally cast materials) is overcome.

Figure 2:
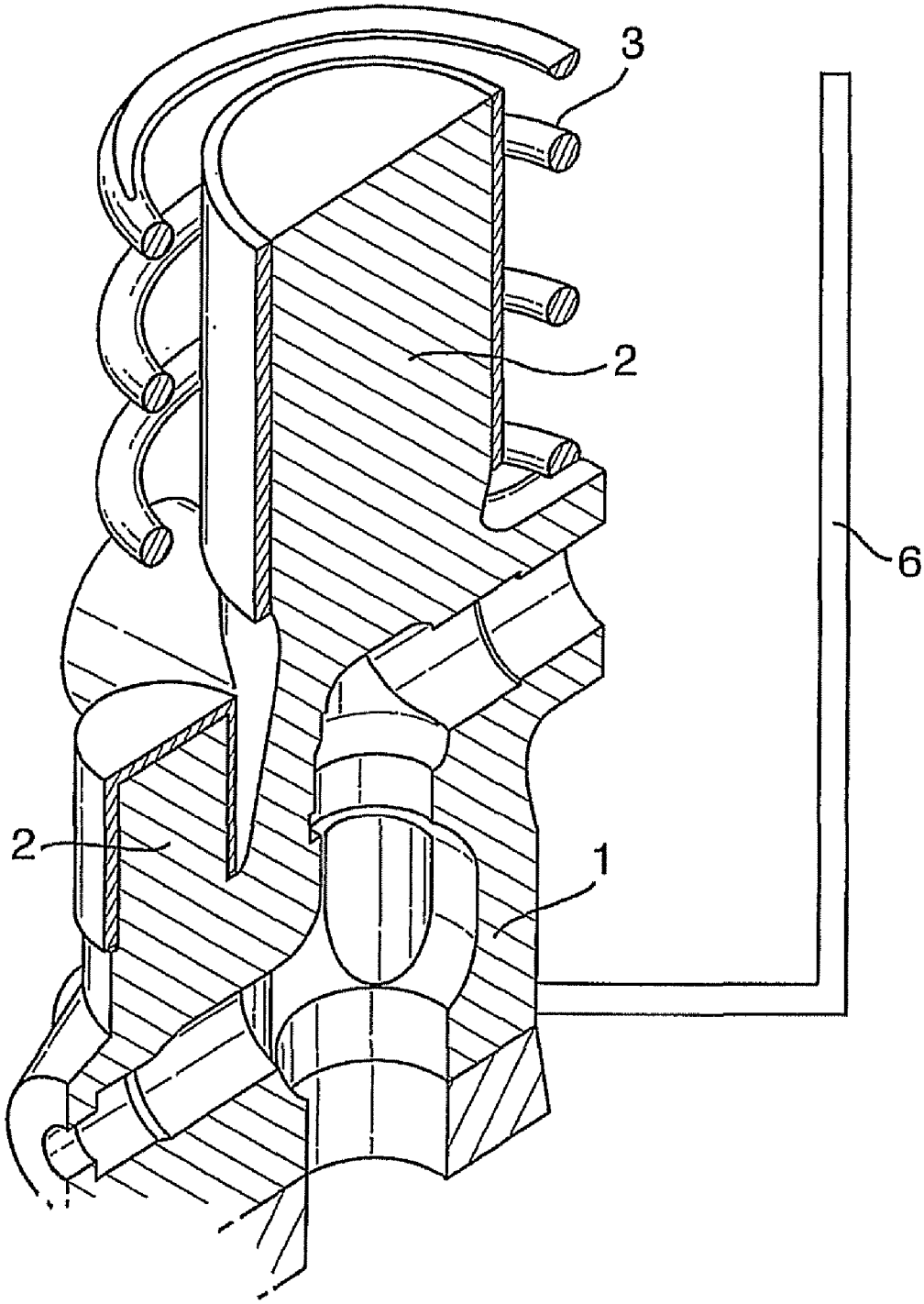

The present invention will now be described by way of example only with reference to the accompanying following figures in which:

FIG. 1 illustrates schematically an apparatus for casting a metal according to the present invention; and FIG. 2 is a perspective cutaway drawing through a valve body casting illustrating the position of an electrically conducting material for inducing eddy currents in liquid metal in a feeder.

Super Nickel alloys (those with greater than 55% Ni) have very different feeding characteristics (i.e. behaviour in a feeder of a mould during casting) to those of steel.

The diameter of the feeders has to be limited because nickel alloys have a very low coefficient of thermal conductivity (nominally 10 W/m° C. in nickel alloys compared with 50 W/m° C. for steels).

If too large a diameter of feeder is used on a super nickel alloy casting then cracks will often be found under the feeder heads. This is due to the very poor thermal conductivity of the nickel alloy.

The outside of the feeder head will, as is normal, solidify first; but by the time the centre of the feeder head solidifies the outside temperature is much lower, than with a steel casting, due to the poor thermal conductivity. This means that due to the shrinkage of the metal in the centre of the feeder from just below solidification temperature to room temperature, very considerable tensile stresses are set up. This happens because, as the diameter of the outside of the feeder head and the rigidity of the outer metal become fixed but, at the same time, the metal in the centre is still cooling and shrinking. This results in very high tensile stresses which are above the ultimate tensile strength of the metal in the centre of the feeder head and therefore cracks occur. Unfortunately during the feeder removal process, be it hot or cold process, these cracks often propagate to through wall thickness defects. Such thermal cracking occurs with feeder head base diameters (or equivalent area of contact between the feeder and moulding) larger than about 400 mm diameter (0.125 $m^2$ equivalent area).

Because of the high thermal conductivity, the thermal gradients required for directional solidification are difficult to control. Nickel alloys have a longer solidification range than, for example, steels.

The criteria for an effective feeder is that i) it does not chill off (described below) and ii) it has enough live liquid volume to overcome the volume shrinkage in the casting. For very large castings of super Ni alloy, shrinkage calculations often show that very large diameter feeder heads (above 400 mm) are required for an effective feeder. However, these very large diameter feeder heads are not possible because such large diameter feeder heads would result in cracking as described elsewhere. One way to deal with this might be to provide a larger number of feeder heads at the expense of added complexity and added waste but unless the smaller heads solidify after the casting the feeder head will not do its job and indeed the larger number of risers tend to keep the casting super heated and thus there is a requirement for even bigger diameter feeders. Thus chill off, where the alloy in the feeder solidifies before the alloy in the mould so that shrinkage of alloy in the mould during cooling cannot be replenished with liquid alloy from the feeder, may still be a problem.

The present invention is directed to using feeder heads with a diameter of 150-900 mm or 300-900 mm or even larger. A preferred range of diameters is 400 to 600 mm. The diameter of the feeder heads is larger than would be possible without the invention and much larger than previously used. However the large diameter is necessary in order to account for shrinkage in large super Ni alloy castings (which have not previously been possible). Such castings may have a size of over 3000 or 6000 kg poured weight or even over 4000 kg or 12000 kg and up to 20000 or 25000 kg finished weight. This equates to a volume of at least 0.5 $m^3$, preferably greater than 0.6 $m^3$ or 0.7 $m^3$ and possibly greater than 1.4 $m^3$. The feeders may be small enough to avoid thermal shrinking induced cracking but large enough to cope with the high thermal shrinkage rates of large super Ni alloy castings. In that case the induced electrical current maintains the alloy in the feeder in the liquid state for longer thereby avoiding chill off. However, in some embodiments the feeders may be larger than the size at which thermal shrinking induced cracking can occur (but may not be as large as the effective feeder), as described below.

In order to maintain alloy in the liquid phase in the feeder head for longer, an electrically conducting material is used for inducing eddy currents in the liquid metal in the feeder thereby to reduce the rate of cooling of the liquid metal in the feeder, particularly in a radially outer portion of the feeder. That is, the magnitude of electrical current induced in the radially outer portion of the feeder is higher than the magnitude of electrical current induced in a central portion of the feeder. Currents may continue to be induced in the metal in the feeder head even after solidification. This can be done as well as or instead of inducing currents in liquid metal. It may be necessary to induce currents in solid metal of the feeder head, if a feeder head with a diameter which is larger than the critical diameter above which thermal contraction induced cracking would otherwise occur is used.

The control of the solidification of 150 to 900 mm diameter feeder heads by induction heating and therefore preventing cracking in super-nickel alloys with more than 30% nickel content will now be described.

As the casting solidifies liquid metal is drawn from the feeder head into the casting to reduce the amount of shrinkage in the casting. By the use of induction heating the primary feeder(s) on the casting can be kept molten for longer than normal. Secondary feeder(s) may not need to be treated in this way.

By keeping the feeder head liquid for a longer period of time it is possible to make castings, particularly but not exclusively for super Ni alloys, with a smaller feeder than is otherwise required. This has the following beneficial effects:

a) The avoidance of the need to use large diameter, full contact, feeders that end up with cracks in the middle as explained above.
b) The ability to make bigger super-nickel alloy castings where section thickness is greater than the normal maximum diameter feeder that can be used.

Additionally or alternatively by reducing the temperature difference (in the horizontal plane) within alloy in the feeder it is possible to make large super Ni alloys with a feeder head which is the same size as the effective feeder which without a reduction in the temperature differences would lead to thermally induced cracking.

There are some conventional ways of attempting to maintain the heat in a feeder. In a first way, insulating material is placed around the extremity of the feeder to reduce heat loss and keeping the feeder "alive" for longer. This is normally in the form of tiles or a pre formed sleeve. Also insulating powers are added to the top of feeders after pouring to also prevent heat loss. A second way uses so called exothermics. Again, these are in the form of sleeves, which contain metal oxides which react with the molten metal on pouring and create an exothermic reaction giving extra heat to the feeder increasing solidification time. Powders are also available which give from mild to highly exothermic reactions having the same effect. The purpose of the insulators and the exothermics is to keep the metal in the feeder liquid for longer than the metal in the casting. This is because unless the feeder head is liquid, it cannot do its job of filling any cavity left by thermal contraction of the metal in the casting. Thermal contraction occurs both on cooling from liquid to solid metal as well as cooling from the solidus temperature down to room temperature. With all of the above existing systems of heat loss control, efficiency of the feeder head is limited, as unless the feeder is quite big, solidification within the feeder head takes place before all of the liquid shrinkage of the casting or ingot can take place. This is typified by the classic primary and secondary shrinkage pipe within a feeder head, and the sinking "u" shape found at the top of all conventional feeders. Theses pipes and "u" shape show that the feeder is only providing liquid metal to the solidifying casting from the centre of the feeder, while the outer regions of the feeder, have already frozen off. These types of methods simply do not provide enough energy to cope with the large feeders required for larger super Ni alloy castings.

Induction heating is the non-contact heating of a metal object by electromagnetic induction, where eddy currents are generated (induced) within the metal and resistance leads to heating of the metal. An induction heater consists of an electrically conducting material, for example in the shape of a coil, through which a medium or high-frequency alternating current (AC) is passed. Induction heating of feeders has been used previously in improving the yield of castings of other types of metal, particularly for smaller mass produced castings of steel and other low melting point metals. However, these metals have conductivities five times greater than super Ni alloys and so do not suffer from thermally induced cracking. These methods are designed to reduce the diameter of the feeder in order to achieve high efficiency. As such, these methods use a feeder with a diameter less than that of the effective feeder.

For the size of feeder and required amount of penetration of the induced eddy currents a preferred range of frequency is 200 to 450 Hz desirably 200 to 350 Hz. A typical power of the alternating current would be at least 200 kW.

The use of induction heating of feeder heads is particularly applicable to alloys containing ≧30% nickel and ≦95% nickel. Typically nickel-chromium-iron, nickel-molybdenum and nickel-chromium-molybdenum alloys, together with other elements.

The invention is particularly applicable to one-off moulds, such as those typically made using the sand moulding technique in which resin bonded particulate matter is used to make the mould. The particulate matter of a sand mould may be: sand, zircon, fused silica, ceramic spheres or chromite for example or any combination thereof. For example, the method may be used for the manufacture of high pressure steam turbine casings for example used in a power station. For the latest advanced ultra super critical turbines the operating temperature of the casing is over 700° C. and this requires the use of super Ni alloys such as inconel 625. Such turbine casings form the high pressure shell. Unfortunately super Ni alloys can be difficult to weld (because of weld induced cracking resulting from the low thermal conductivity of the material). However, as the casings are 11-12 tonnes they can also be difficult to cast without use of the present invention.

The use of induction heating of feeder heads allows the feeder head diameter to be smaller than would otherwise be necessary for a given size of casting. Cracking due to thermal contraction can be avoided by reducing the diameter of the feeder and/or by controlling the cooling rate of the metal at the outside of the feeder head. In the later case, the induction heating is used to reduce the temperature profile through the thickness of the feeder head as the metal in the feeder head cools. That is, the magnitude of temperature differences (in a horizontal plane) in alloy in the feeder are reduced. For example the outside of the feeder head has a current induced in it to slow its cooling rate so that its temperature more closely matches the temperature of the inside of the feeder head. This reduces the thermal strain induced in the feeder head by thermal contraction effects and reduces the chance of thermal cracking. As a result use of feeders with diameters with a large enough diameter for large castings are possible. The dimensions of feeder head of the present invention are given below.

Feeder diameter range: From 150 mm to 900 mm, preferably 300-900 mm, more preferably 500-900 mm. A preferred range is 400-600 mm. Feeder diameters larger than 900 mm are also possible, particularly with controlled cooling to achieve lower thermal gradients within the feeder head. The feeder may not be circular in cross-section. In that case the cross-sectional area of the feeder would be equivalent to the cross sectional area of a circular feeder pipe with a diameter in the above ranges.

Feeder height range: The feeder height to feeder base diameter ratio (H:D ratio) 1:1 to 5:1, preferably 1.25:1 to 4:1, more preferably 1.6:1 to 2.5:1

Equivalent Feeder contact surface area with mould range: 0.125-0.295 $m^2$ (400-600 mm diameter equivalent)

In order to induce a current in the metal in the feeder head, an electrically conducting material is provided. Preferably the electrically conducting material is in the form of an induction coil.

The induction coil is incorporated in sand of the sand mould which is preferably used during the moulding process. Once the casting is conventionally poured a current is applied through the electrically conducting material using a power pack 5. Alternatively a separate (attached) induction coil is positioned around the feeder head and a current applied.

The induction coil is then used to control the solidification of the feeder head, allowing for longer feeder solidification times and increasing the efficiency of the feed metal. That allows big castings to solidify before the feeder head which would solidify earlier but for the induction heating. It may also be used to slow the rate of cooling of the riser from solidus (or just between liquidus and solidus) temperature to room temperature. Larger diameter of feeders can be used as the slow cooling will avoid a large temperature gradient across the radial diameter of the feeder. During the later phases of cooling (above or below solidus) the inducing of electrical current may take place intermittently (non-continuous), or at a lower power.

The electrical current is induced along the length of alloy in the feeder (otherwise there is a risk that thermal cracking will occur where the electrical current is not induced).

Following cooling of the casting below the solidus temperature (for example to a temperature at which the casting may safely be handled) the casting is removed from the mould. Heat treatment of the casting may then take place, for example in a furnace. For example, heat treating may take place at a temperature in excess of 1200° C.

This apparatus and method results in the following advantages:

a) The ability to make larger castings in super-nickel alloys due to the reduction of the thermal limitation of riser diameter. Otherwise castings of this size could not be made.

b) Less energy required.

c) Quicker feeder removal because of the reduced diameter.

d) Lower cooling gradient across the feeder radial diameter.

FIG. 1 is a schematic view of a casting 1. The apparatus for making the casting 1 comprises a mould which defines the desired shape of the casting 1. A feeder is also provided in the mould. Liquid metal is poured into the mould through an ingate 6 or the feeder. The mould is filled to a level such that metal fills the feeder to near its top. During solidification and thereby contraction of the casting 1, liquid metal from the feeder head 2 will move into the casting under hydrostatic pressure so that the casting is as close to the desired shape as possible and so that no shrinkage voids due to thermal contraction are formed. As can be seen from FIG. 2, the mould preferably comprises an ingate 6 which is used to provide liquid metal to the mould. The ingate 6 is in the form of a pipe which leads from about the top level of the feeder to the bottom of the mould so that liquid metal fills the mould from the bottom. A metal plate or similar may be placed at the bottom of the mould in order to chill the liquid metal so that solidification starts from the bottom of the mould furthest from the feeder head 2.

The mould also includes an electrically conducting material 3. This is also illustrated in FIG. 1 (it is the only part of the apparatus which is illustrated in FIG. 1). In the preferred embodiments the electrically conducting material 3, which is for inducing any currents in liquid metal in the feeder (i.e. liquid metal which forms the feeder head), is in the shape of a coil. However, other shapes may be suitable.

The electrically conductive material may be embedded in material of the mould. For example, if the mould is a sand mould then the electrically conductive material can be embedded into the sand during shaping of the sand into the desired shape of the mould. Alternatively, the electrically conductive material can be placed around the refractory material forming a feeder and thereby not be embedded in the mould.

Because of their low thermal conductivity super Ni alloy castings take a long time to solidify. This provides particular challenges for the mould. In particular, the refractory material of the mould may become very hot. Indeed, it is possible for the electrically conducting material 3 used for inducing eddy currents in the liquid metal in the feeder to reach its own metal point. For this purpose a cooling system 4 is provided for cooling the electrically conducting material during use. One way of providing for this is to pass a heat transfer fluid through, around or close to the electrically conducting material 3. One way of doing this is to provide the electrically conducting material 3 in the form of a tube and to pass the cooling fluid (liquid or gas) through the tube. Some induction furnaces use a hollow induction coil through which cooling liquid (usually water) is passed. However, in the present invention preferably a cooling gas is used rather than water. This is because there is a danger as water and molten metal can lead to an explosion, which would occur if the coil melted whilst there was still molten metal in the mould, gas is a far preferable cooling medium. Therefore the use of a gas as the heat transfer fluid for taking heat away from the electrically conducting material is preferred. The cooling gas might be an inert (pure) gas such as nitrogen or argon, or could be a mixture of gasses (for example air) or could be a refrigerant gas.

In the cooling system 4 cold heat transfer fluid is pumped in at one end of the electrically conducting material in the mould. The heat transfer fluid heats up as it passes the electrically conducting material. At the other end of the electrically conducting material the heat transfer fluid is removed at which point it is at a higher temperature than when it first came into contact with the electrically conducting material. The heat transfer fluid can then either be disposed of or can be recycled in which case it will need to be cooled prior to being pumped back through, around or close to the electrically conducting material to perform its cooling task.

Many variations of cooling system are possible. For instance, it is not necessary for the cooling fluid to pass all the way along the electrically conducting material. For instance, the electrically conducting material could be split into several lengths each of which are part of an independent cooling system.

In an embodiment the coil could be made out of a higher temperature melting point metal that would add to the safety and robustness of the coil.

Now a description will be given of how the apparatus for making a casting is used.

The casting is conventionally poured, with an induction coil (moulded) in position around the feeder head. The radial distance from the feeder edge is between 10 and 300 mm, preferably between 40 and 10 mm, most preferably about 75 mm.

The induction coil 3 is then used to control the solidification of the feeder head, allowing for longer feeder solidification times and increasing the efficiency of the feed metal. When a feeder head (also known as a riser) has a smaller mass than the section of the casting it is feeding it will chill off and fail to do its job.

First the mould and feeder are designed. The effective feeder diameter is calculated. If it is above the diameter at which cracking will occur, it is decided whether to make the diameter smaller or to maintain it at that size or even larger. If the effective feeder size is such a size that cracking will occur, use of the present invention will need to be made. After the mould has been prepared (for example a sand mould), the liquid metal may be poured through a riser or an in-feed gate into the mould such that liquid alloy is present in the feeder of the mould.

a) Straight away or in the first, approximately, 10 minutes after pouring the induction coil 3 is not energised but it does have a cooling media (gas or liquid) continuously circulated through it to prevent the induction coil from melting.

b) Straight away or after the first, approximately, 10 minutes the induction coil is energised with a local induction melting furnace power pack 5 and the temperature of the feeder sitting within the coil 3 is kept molten for the period that the ultimate cast shape of the casting takes to solidify.

After this time has elapsed the induction can be de-energised but the cooling medium must be kept flowing through the coil for a considerable time (hours) until such time as the radiated and conducted heat can no longer melt the coil.

After the alloy in the feeder has reached solidus, it may still be necessary to (continue to) reduce temperature profiles in the horizontal plane of the feeder to avoid thermal cracking during further cooling. Therefore, it may be necessary to induce electrical current in solid alloy in the feeder to reduce its rate of cooling. The electrical current should be induced to reduce the magnitude of temperature differences within alloy in the feeder. During this phase (as during previous phases), the inducing may be non-continuous (the alternating current may be switched on and off) and/or the power of the alternating current may be reduced.

Therefore, a sound casting can be produced.

As can be seen from FIG. 2, a casting may include more than one feeder head 2 as well as an ingate 6. As can be seen, the size of the feeder heads is great so that the feeder heads solidify after the casting. The present invention allows smaller feeder heads to be utilised as solidification is controlled so that the casting has almost solidified itself before the feeder is allowed freeze. That is, because solidification of the feeder head can be controlled, piping in the feeder (where the outside of the feeder solidifies first and liquid metal in the centre of the feeder flows downwards leaving a cavity in the top middle of the feeder head) can be avoided. This is done by maintaining the outside of the feeder head liquid for longer than would occur without the induction heating. This can result in a flat feed which is a feeder head which is cylindrical without piping.

A flat feed can be achieved, or a feeder head of a diameter larger than that which would be possible without thermally induced cracking can be used if induction heating is used. A thermocouple 7 can provide information about the temperature of the outside of the feeder head and this information can be used in a feedback or feedforward manner by a controller of the power pack 5 to induce enough current in the feeder head (particularly in the outside of the feeder head) to keep the temperature of the outer surface of the feeder head liquid. Once solidification has taken place, the same or a similar control loop can be used to ensure a near uniform temperature profile (radially) though the feeder head 2 during cooling to room temperature. This can also be important because during cooling from the solidus (about 1400 C.) to room temperature it is still possible for thermally induced cracking to occur. Therefore the controller of the induction heater can continue to control the temperature of the outer surface of the feeder head during cooling (reduce its cooling rate) and thereby larger diameter feeder heads 2 than could otherwise be used can be used with the present invention.

A further benefit to the system is the ability to keep the feeder head "alive" for longer which then can enable further topping up of the head with metal.

In an embodiment an apparatus for making a super Ni alloy casting is disclosed. The apparatus comprises: a mould including a feeder; and an electrically conducting material for inducing eddy currents in metal in said feeder. Desirably said feeder has a diameter of greater than 150 mm. Desirably said feeder has a diameter of greater than 300 mm, preferably greater than 500 mm. Desirably said mould has a volume of greater than 0.5 $m^3$, preferably greater than 0.6 $m^3$, more preferably greater than 0.7 $m^3$. Desirably a ratio of the height to the diameter of said feeder is in the range of 1:1 to 5:1, preferably 1.25:1 to 4:1. Desirably the apparatus comprises a cooling system for cooling said electrically conducting material during use. Desirably said cooling system uses a gas as a heat transfer fluid for removing heat from said electrically conducting material. Desirably the apparatus comprises a plurality of feeders. Desirably said mould further comprises an ingate for the introduction of liquid metal into said mould. Desirably the apparatus further comprises a controller, in use, for controlling the current induced in said liquid metal and thereby to control the cooling rate of metal in said feeder. Desirably the apparatus further comprises a sensor for sensing the temperature of metal in said feeder and said controller controls the current induced by said electrically conducting material based on the temperature measured by said sensor. Desirably said sensor is for measuring the temperature of metal in a radially outer portion of said feeder. In an embodiment, an apparatus for casting a metal, comprises: a mould including a feeder; an electrically conducting material for inducing eddy currents in metal in said feeder; wherein said feeder has a diameter of greater than 150 mm. Desirably said diameter of said feeder is greater than 300 mm, preferably greater than 500 mm. Desirably said mould has a volume of greater than 0.5 $m^3$, preferably greater than 0.6 $m^3$, more preferably greater than 0.7 $m^3$. Desirably a ratio of the height to the diameter of said feeder is in the range of 1:1 to 5:1, preferably 1.25:1 to 4:1. Desirably the apparatus further comprises a cooling system for cooling said electrically conducting material during use. Desirably said cooling system uses a fluid (liquid or gas) as a heat transfer fluid for removing heat from said electrically conducting material. Desirably said mould comprises a plurality of feeder heads. Desirably said mould further comprises an ingate for the introduction of liquid metal into said mould. Desirably the apparatus further comprises a controller, in use, for controlling the current induced in said liquid metal and thereby to control the cooling rate of metal in said feeder. Desirably the apparatus further comprises a sensor for sensing the temperature of metal in said feeder and said controller controls the current induced by said electrically conducting material based on the temperature measured by said sensor. Desirably said sensor is for measuring the temperature of metal in a radially outer portion of said feeder. Desirably said apparatus is for making a super Ni alloy casting.

In an embodiment an apparatus for making a casting of metal comprises: a mould including a feeder; and an electrically conducting material for inducing eddy currents in metal in said feeder; and a cooling system for cooling said electrically conducting material during use. Desirably said cooling system uses a gas as a heat transfer fluid for removing heat from said electrically conducting material. Desirably said cooling system uses a liquid as a heat transfer fluid for removing heat from said electrically conducting material. Desirably said liquid is water or other liquid. Desirably said feeder has a diameter of greater than 150 mm. Desirably said feeder head has a diameter of greater than 300 mm, preferably greater than 500 mm. Desirably said mould has a volume of greater than 0.5 $m^3$, preferably greater than 0.6 $m^3$, more preferably greater than 0.7 $m^3$. Desirably a ratio of the height to the diameter of said feeder is in the range of 1:1 to 5:1, preferably 1.25:1 to 4:1. Desirably said mould has a plurality of feeders. Desirably said mould further comprises an ingate for the introduction of liquid metal into said mould. Desirably the apparatus further comprises a controller, in use, for controlling the current induced in said liquid metal and thereby to control the cooling rate of metal in said feeder. Desirably the apparatus further comprises a sensor for sensing the temperature of metal in said feeder and said controller controls the current induced by said electrically conducting material based on the temperature measured by said sensor. Desirably said sensor is for measuring the temperature of metal in a radially outer portion of said feeder. Desirably said apparatus is for making a super Ni alloy casting.

In an embodiment a method of casting a super Ni alloy comprises: pouring liquid alloy into a mould such that liquid alloy is present in a feeder of said mould; and inducing an electrical current in alloy in said feeder to reduce a rate of cooling said alloy in said feeder. Desirably said feeder has a diameter of greater than 150 mm, preferably greater than 300 mm, more preferably greater than 500 mm. Desirably at least 3 tonnes of liquid alloy, preferably at least 6 tonnes of liquid alloy, is poured through said feeder. Desirably a ratio of the height to the diameter of said feeder is in the range of 1:1 to 5:1, preferably 1.25:1 to 4:1. Desirably the method further comprises cooling electrically conducting material used for inducing said electrical current. Desirably said cooling comprises transferring heat from said electrically conducting material using a gas. Desirably said cooling comprises transferring heat from said electrically conducting material using liquid. Desirably said pouring liquid alloy through a feeder comprises pouring liquid alloy through a plurality of feeders. Desirably said pouring comprises pouring liquid metal into said mould through an ingate. Desirably the method further comprises controlling the current induced in said liquid metal and thereby to control the cooling rate of metal in said feeder based on the temperature of metal in said feeder. Desirably said temperature of metal in said feeder is the temperature of metal in a radially outer portion of said feeder.

In an embodiment a method of casting an alloy comprises: pouring liquid alloy into a mould such that liquid alloy is present in a feeder of said mould; and inducing an electrical current in alloy in said feeder to reduce a rate of cooling said alloy in said feeder, wherein said feeder has a diameter of greater than 150 mm.

In an embodiment a method of casting an alloy comprises: pouring liquid alloy into a mould such that liquid alloy is present in a feeder of said mould; inducing an electrical current in alloy in said feeder to reduce a rate of cooling said alloy in said feeder; and cooling an electrically conductive material used for inducing said electrical current.

The invention claimed is:

1. A method of mitigating against thermal contraction induced cracking during casting of a super Ni alloy, the method comprising:

pouring at least 6 tonnes of liquid alloy into a mould such that the liquid alloy is present in a feeder of said mould; and inducing an electrical current in the liquid alloy in said feeder to reduce a rate of cooling of the liquid alloy in said feeder, and further inducing the electrical current in the alloy after it has reached solidus to slow cooling in the solid state and form the casting.

2. The method of claim 1, wherein the induced electrical current reduces the magnitude of temperature differences within the alloy in the feeder.

3. The method of claim 1, wherein a ratio of the height to the base diameter of said feeder is in the range of: 1.25:1 to 4:1.

4. The method of claim 1, wherein said feeder has a diameter of greater than 150 mm.

5. The method of claim 1, wherein the feeder has a diameter of between 400 and 600 mm.

6. The method of claim 1, wherein the total contact surface area of any feeder to the moulding is between 0.125 and 0.295 $m^2$.

7. The method of claim 1, wherein the mould is comprised of resin bonded particulate matter.

8. The method of claim 1, in which the feeder has a diameter greater than that at which the alloy in the feeder would suffer from thermally induced cracking without the induced electrical currents.

9. The method of claim 1, wherein the electrical current is induced along the length of the alloy in the feeder.

10. The method of claim 1, wherein the electrical current is induced in the alloy using an alternating current with a frequency in the range of 200 Hz to 450 Hz.

11. The method of claim 1, wherein the magnitude of electrical current induced in a radially outer portion of said feeder is higher than the magnitude of electrical current induced in a central portion.

12. The method of claim 1, wherein the electrical current is induced by an alternating current of at least 200 kW.

13. The method of claim 1, wherein said inducing is non continuous during a period in which inducing is performed.

14. The method of claim 1, wherein the electrical current is induced in substantially all alloy in the feeder.

15. The method of claim 1, further comprising cooling electrically conducting material used for inducing said electrical current.

16. The method of claim 1 further comprising:

cooling the casting below solidus temperature;

removing the casting from the mould; and heat treating the casting.

17. The method of claim 1, wherein the casting is a high pressure steam turbine casing.

18. The method of claim 1, wherein a ratio of the height to the base diameter of said feeder is in the range of: 1.6:1 to 2.5:1.

19. The method of claim 1, wherein said feeder has a diameter of greater than 300 mm.

20. The method of claim 1, wherein said feeder has a diameter of greater than 500 mm.

* * * * *